US008884862B2

(12) United States Patent
Choi et al.

(10) Patent No.: US 8,884,862 B2
(45) Date of Patent: Nov. 11, 2014

(54) DISPLAY AND METHOD OF DRIVING THE SAME

(75) Inventors: Yang-Hwa Choi, Yongin (KR); Seung-Kyu Lee, Yongin (KR); Kyung-Hoon Kim, Yongin (KR); Chul-Ho Kim, Yongin (KR); Se-Hyang Kim, Yongin (KR)

(73) Assignee: Samsung Display Co., Ltd., Gyeonggi-Do (KR)

( * ) Notice: Subject to any disclaimer, the term of this patent is extended or adjusted under 35 U.S.C. 154(b) by 553 days.

(21) Appl. No.: 12/946,176

(22) Filed: Nov. 15, 2010

(65) Prior Publication Data

US 2011/0227894 A1 Sep. 22, 2011

(30) Foreign Application Priority Data

Mar. 18, 2010 (KR) ..... 10-2010-0024423

(51) Int. Cl.
*G09G 3/36* (2006.01)

(52) U.S. Cl.
CPC ..... *G09G 3/3655* (2013.01); *G09G 2310/0281* (2013.01); *G09G 2330/021* (2013.01); *G09G 2320/0252* (2013.01); *G09G 2300/0814* (2013.01)
USPC ..... 345/95; 345/210

(58) Field of Classification Search
USPC ..... 345/94, 95, 210, 211
See application file for complete search history.

(56) References Cited

U.S. PATENT DOCUMENTS 8,044,908 B2 * 10/2011 Lee ..... 345/94
2002/0047822 A1 * 4/2002 Senda et al. ..... 345/90
2007/0273630 A1 * 11/2007 Lee ..... 345/92

(Continued)

FOREIGN PATENT DOCUMENTS

KR 10-2007-0028063 A 3/2007

(Continued)

OTHER PUBLICATIONS

Korean Notice of Allowance dated Apr. 25, 2012 for Korean Patent Application No. KR 10-2010-0024423 which corresponds to captioned U.S. Appl. No. 12/946,176.
Korean Office Action dated Jun. 7, 2011 for Korean Patent Application No. KR 10-2010-0024423 which corresponds to captioned U.S. Appl. No. 12/946,176.

*Primary Examiner* — Chanh Nguyen
*Assistant Examiner* — Roy Rabindranath
(74) *Attorney, Agent, or Firm* — Knobbe, Martens, Olson & Bear LLP

(57) ABSTRACT

A display device includes: a plurality of pixels; a data driver connected to the plurality of pixels by a plurality of data lines and applying data signals to the plurality of pixels; a scan driver connected to the plurality of pixels by a plurality of scan lines and applying scan signals to the plurality of pixels for the data signals to be applied to the plurality of pixels; a boost driver connected to the plurality of pixels by a plurality of boost lines and applying boost signals, boosting the pixel voltage charged to the plurality of pixels by the data signals, to the plurality of pixels; and a boost voltage maintaining unit applying a restoring voltage restoring the voltage in the plurality of boost lines by the scan signal to the plurality of boost lines. The voltage generated in the boost line by the coupling may be quickly restored and the crosstalk may be minimized, thereby improving the image quality.

21 Claims, 7 Drawing Sheets

(56) References Cited

U.S. PATENT DOCUMENTS

| | | | | |
|---|---|---|---|---|
| 2008/0094531 | A1* | 4/2008 | Lee et al. | 349/39 |
| 2009/0086116 | A1* | 4/2009 | Pak | 349/38 |
| 2010/0214272 | A1* | 8/2010 | Watsuda | 345/205 |
| 2011/0037787 | A1* | 2/2011 | Yoshiga | 345/690 |

FOREIGN PATENT DOCUMENTS

| | | | |
|---|---|---|---|
| KR | 10-2007-0077348 | A | 7/2007 |
| KR | 10-2008-0054549 | A | 6/2008 |
| KR | 10-2009-0032712 | A | 4/2009 |
| KR | 10-2009-0075517 | A | 7/2009 |

* cited by examiner

DISPLAY AND METHOD OF DRIVING THE SAME

CROSS-REFERENCE TO RELATED APPLICATION

This application claims the benefit of Korean Patent Application No. 10-2010-0024423, filed Mar. 18, 2010, in the Korean Intellectual Property Office, the disclosure of which is incorporated herein by reference.

BACKGROUND

1. Field

An aspect of the present invention relates a display device. More particularly, an aspect of the present invention relates to a display device using an ambient light sensor (ALS) driving method.

2. Description of the Related Art

As a representative display device, a liquid crystal display (LCD) includes two panels provided with pixel electrodes and a common electrode, and a liquid crystal layer having dielectric anisotropy interposed between the two panels. The pixel electrodes are arranged in a matrix format and are connected to a switch such as a thin film transistor (TFT) to sequentially receive a data voltage by row. The common electrode is formed over the entire surface of the panel to receive a common voltage. The pixel electrodes, the common electrode, and the liquid crystal layer interposed between the pixel electrodes and the common electrode form a liquid crystal capacitor from a circuital view, and the liquid crystal capacitor and a switch connected thereto become a basic unit forming a pixel.

In the liquid crystal display (LCD), an electric field is generated in the liquid crystal layer by applying voltages to the two electrodes, and transmittance of light passing through the liquid crystal layer is controlled by controlling the electric field to thereby display a desired image. In order to prevent a degradation phenomenon that occurs when the electric field is applied in the liquid crystal layer in one direction for a long time, polarities of the data voltage with respect to a common voltage are inverted for every frame, every row, or every pixel.

The ALS driving method as a driving method boosting a voltage of a pixel boosts the voltage of the pixel electrode that is floated after a gate voltage is off by coupling it with the voltage of an ALS line. The boosting of the voltage of the pixel electrode may be induced by increasing or decreasing the voltage of the boost line during one frame. The ALS driving method may reduce a source output voltage of a driving circuit, thereby reducing power consumption. Also, the ALS driving method may increase the pixel voltage, and the response speed of the liquid crystal may be improved through the application of the high pixel voltage.

However, the ALS line has a same direction of a scan line and overlaps the data line, such that the voltage of the boost line may have noise by coupling with the voltages applied to the data line and the scan line.

For example, the voltage of the boost line is generated by the coupling when the gate voltage is on. The voltage generated in the boost line must be restored until the gate voltage is off. If the voltage generated in the boost line is not restored until the gate voltage is off, the output signal of the boost line is increased. Particularly, the coupling influence of the boost line is increased further away from the output terminal of the boost signal, and the component that the voltage of the boost line is not restored is increased when the gate voltage is off.

The deviation of the component that the voltage of the boost line is not restored is increased when the gate voltage is off generates the difference between the pixel voltages, and thereby crosstalk may be generated.

The above information disclosed in this Background section is only for enhancement of understanding of the background of the invention and therefore it may contain information that does not form the prior art that is already known in this country to a person of ordinary skill in the art.

SUMMARY

An aspect of the present invention provides a display device and a driving method capable of quickly restoring a voltage generated in a boost line by coupling.

A display device according to an exemplary embodiment of the present invention includes: a plurality of pixels; a data driver connected to the plurality of pixels by a plurality of data lines and applying data signals to the plurality of pixels; a scan driver connected to the plurality of pixels by a plurality of scan lines and applying scan signals to the plurality of pixels for the data signals to be applied to the plurality of pixels; a boost driver connected to the plurality of pixels by a plurality of boost lines and applying boost signals boosting the pixel voltage charged to the plurality of pixels by the data signals to the plurality of pixels; and a boost voltage maintaining unit applying a restoring voltage restoring the voltage in the plurality of boost lines by the scan signal to the plurality of boost lines.

The boost driver may be connected to one end of the plurality of boost lines, and the boost voltage maintaining unit is connected to the other end of the plurality of boost lines.

The boost voltage maintaining unit may apply the restoring voltage by using a clock signal controlling the output of the scan signal or the scan signal as a gate signal.

The boost voltage maintaining unit may include: a NAND operator receiving an inversion signal inverting the polarity of the data signal and the previously applied boost signal as the input signal; at least one NOT operator sequentially connected to the output terminal of the NAND operator; and a transfer gate switch connected to at least one NOT operator and receiving the clock signal or the scan signal as the gate signal. The boost voltage maintaining unit may further include a NOT operator inverting the inversion signal.

The previously applied boost signal may be the boost signal that is applied to the previous boost line among the boost signals that are sequentially applied to the plurality of boost lines. At least one NOT operator may be odd-numbered.

The previously applied boost signal may be a boost signal that is applied to a secondly previous boost line among the boost signals that are sequentially applied to the plurality of boost lines. At least one NOT operator may be even-numbered.

The transfer gate switch may be a CMOS transfer gate switch having the clock signal and the scan signal as the gate signal. The scan driver and the boost driver may be disposed on the same side of a panel including the plurality of pixels.

The transfer gate switch may be an NMOS transfer gate switch having the scan signal as the gate signal. The scan driver and the boost driver may be disposed on the other side of the panel including the plurality of pixels.

The restoring voltage may be the boost voltage of the level before the change of the boost signal that is changed for boosting the voltage of the plurality of pixels.

The data driver may invert the polarity of the data signal as a unit of one horizontal period, and may apply the data signal to the plurality of pixels.

A driving method of a display device according to another exemplary embodiment of the present invention includes: applying scan signals to scan lines connected to a plurality of pixels; applying data signals to data lines connected to the plurality of pixels; and applying a restoring voltage restoring the voltage generated in boost lines connected to the plurality of pixels by the scan signals.

The applying of the restoring voltage may include: inputting an inversion signal inverting the polarity of the data signals and the previously applied boost signal to a NAND operator; inputting signals output from the NAND operator to at least one NOT operator; and applying signals output from the NOT operator to the boost lines as a restoring voltage.

The signal output from the NOT operator may be input to a transfer gate switch receiving a clock signal controlling the output of the scan signal or the scan signal as a gate signal, and the restoring voltage is input to the boost line according to the input of the clock signal or the scan signal to the transfer gate switch.

The inversion signal may be inverted and input to the NAND operator.

The previously applied boost signal may be the boost signal that is applied to the previous boost line among the boost signals that are sequentially applied to the plurality of boost lines. At least one NOT operator may invert the signal output from the NAND operator at odd-numbered times and output the inverted signal.

The previously applied boost signal may be the boost signal that is applied to the secondly previous boost line among the boost signals that are sequentially applied to the plurality of boost lines. At least one NOT operator may invert the signal output from the NAND operator at even-numbered times and output the inverted signal.

The restoring voltage may be the boost voltage of the level before the change of the boost signal that is changed for boosting the voltage of the plurality of pixels.

The method may further include applying the boost signal boosting pixel voltages charged in the plurality of pixels to the boost line after applying the restoring voltage to the boost line.

The voltage generated in the boost line by the coupling may be quickly restored and the crosstalk may be minimized, and thereby the image quality may be improved.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION

Figure 1:
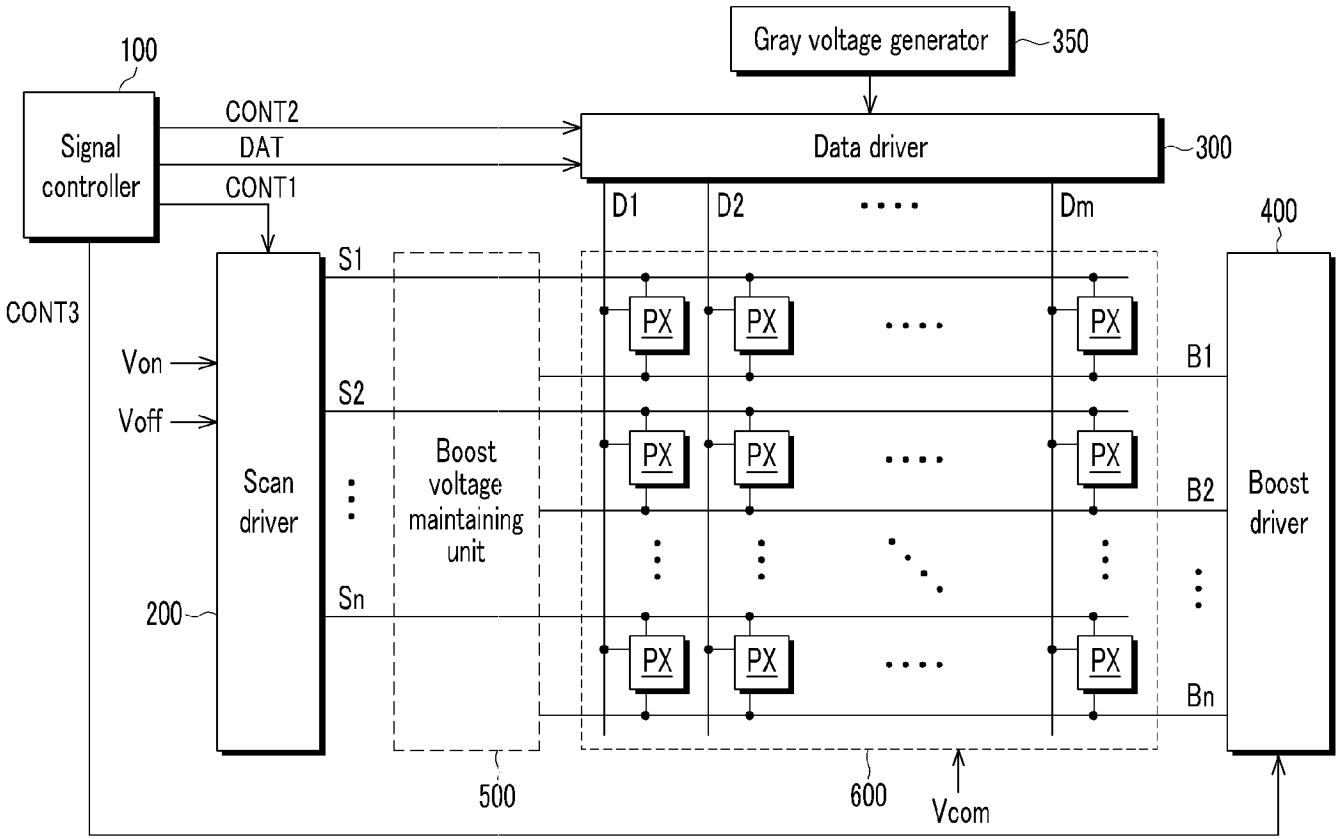
FIG. 1 is a block diagram of a liquid crystal display (LCD) according to an exemplary embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements. Moreover, it is to be understood that where is stated herein that one film or layer is "formed on" or "disposed on" a second layer or film, the first layer or film may be formed or disposed directly on the second layer or film or there may be intervening layers or films between the first layer or film and the second layer or film. Further, as used herein, the term "formed on" is used with the same meaning as "located on" or "disposed on" and is not meant to be limiting regarding any particular fabrication process.

Firstly, a configuration and an operation of a liquid crystal display (LCD) according to an exemplary embodiment of the present invention will be described with reference to FIG. 1 to 5.

Figure 2:
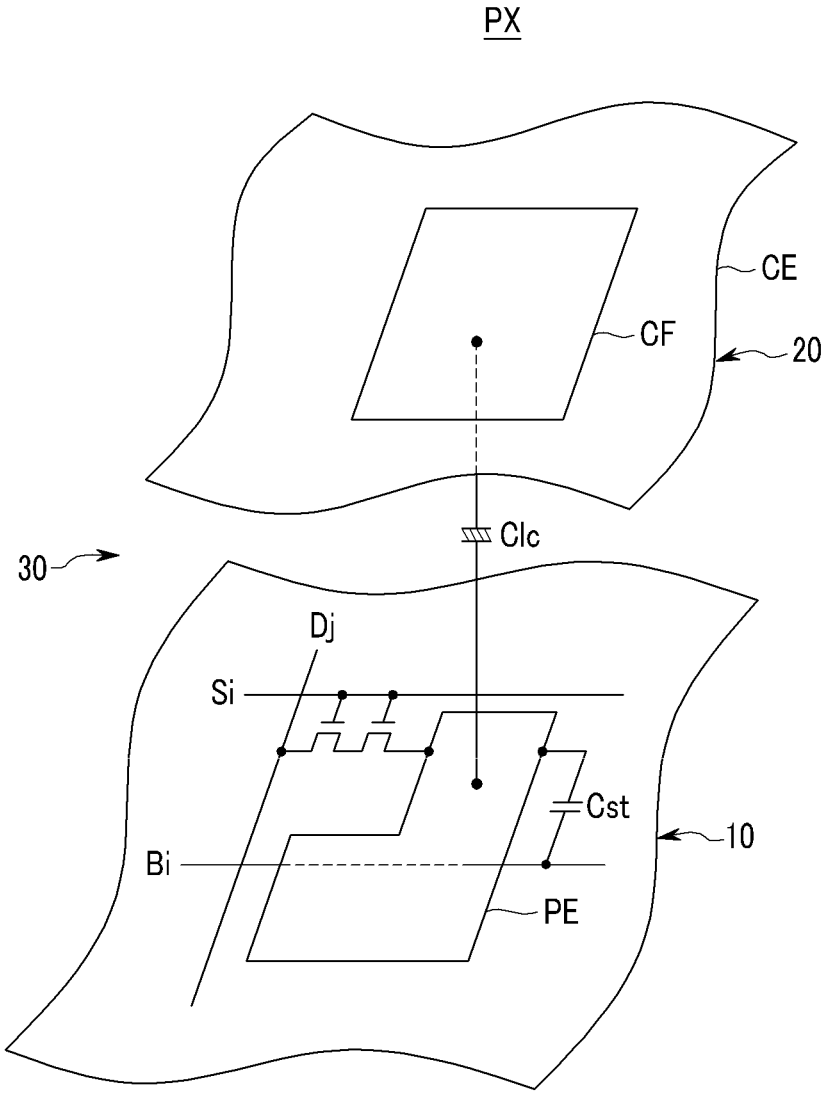
FIG. 2 is an equivalent circuit of one pixel of FIG. 1.
Figure 3:
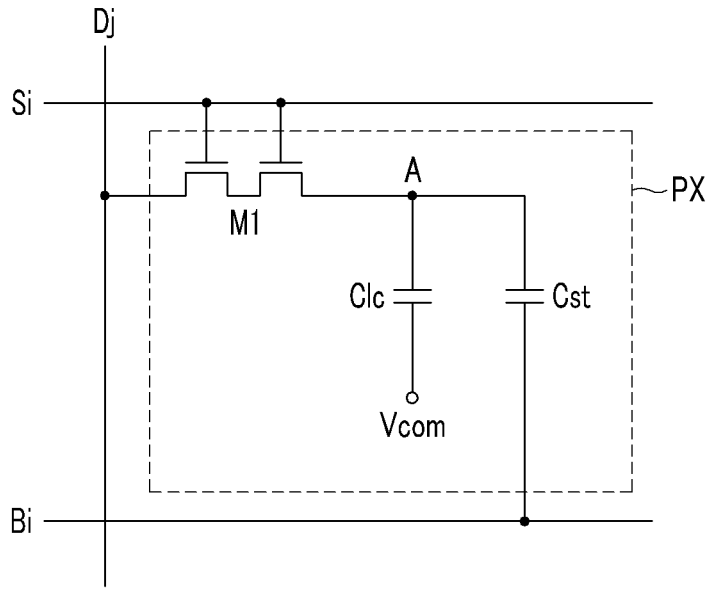
FIG. 3 is a circuit diagram to explain an operation of a liquid crystal display (LCD) of FIG. 1.
Figure 4:
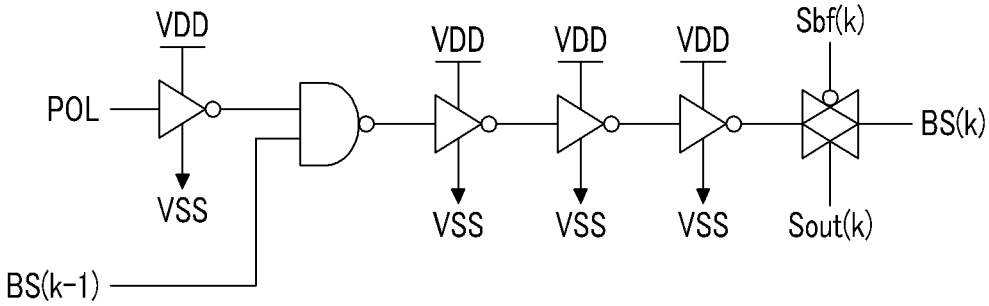
FIG. 4 is one example of a logic calculation circuit of the boost voltage maintaining unit of FIG. 1.
Figure 5:
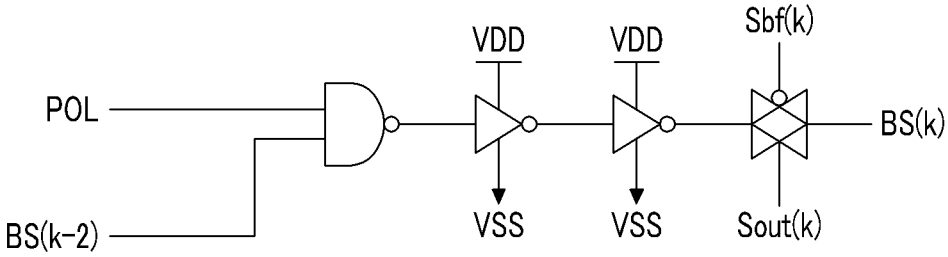
FIG. 5 is another example of a logic calculation circuit of the boost voltage maintaining unit of FIG. 1.

FIG. 1 is a block diagram of a liquid crystal display (LCD) according to an exemplary embodiment of the present invention. FIG. 2 is an equivalent circuit of one pixel of FIG. 1. FIG. 3 is a circuit diagram to explain an operation of a liquid crystal display (LCD) of FIG. 1. FIG. 4 is one example of a logic calculation circuit of the boost voltage maintaining unit of FIG. 1. FIG. 5 is another example of a logic calculation circuit of the boost voltage maintaining unit of FIG. 1.

Referring to FIG. 1, a liquid crystal display (LCD) includes a liquid crystal panel assembly 600, a scan driver 200, a data driver 300, a boost driver 400, and a boost voltage maintaining unit 500 connected thereto, a gray voltage generator 350 connected to the data driver 300, and a signal controller 100 controlling the drivers 200, 300, and 400.

The liquid crystal panel assembly 600 includes a plurality of scan lines S1-Sn, a plurality of data lines D1-Dm, a plurality of boost lines B1-Bn, and a plurality of pixels PX connected to the plurality of signal lines 1-Sn, D1-Dm, and B1-Bn and arranged in form of a matrix.

The gate lines G1 to Gn extend in an approximate row direction and are almost parallel to each other, and the boost lines B1-Bn correspond to the gate lines G1-Gn thereby extending in the approximate row direction. The data lines D1 to Dm extend in a column direction and almost parallel to each other. At least one polarizer (not shown) polarizing light is attached on an outer surface of the liquid crystal panel assembly 600.

The plurality of scan lines S1-Sn are connected to the scan driver 200, and the plurality of data lines D1-Dm are connected to the data driver 300. One end of each of the plurality of boost lines B1-Bn is connected to the boost driver 400, and the other ends thereof are connected to the boost voltage maintaining unit 500.

Referring to FIG. 2, the liquid crystal panel assembly 600 includes a thin film transistor array panel 10 and a common electrode panel 20 facing each other, a liquid crystal layer 30 interposed therebetween, and a spacer (not shown) forming a gap between the two panels 10 and 20 and compressed to some degree.

Referring to FIGS. 2 and 3, and referring to one pixel PX of the liquid crystal panel assembly 300, the pixel PX connected to the i-th (i=1–n) gate line Gi (not shown), the boost line Bi, and the j-th (j=1–m) data line Dj includes a switching transistor M1, and a liquid crystal capacitor Clc and a sustain capacitor Cst1 connected thereto.

The switching transistor M1 as a three terminal element such as a thin film transistor provided in the thin film transistor array panel 10 includes a gate electrode connected to the scan line Si, an input terminal connected to the data line Di, and an output terminal connected to the pixel electrode PE of the liquid crystal capacitor Clc. Here, the thin film transistor may include amorphous silicon or polycrystalline silicon.

The liquid crystal capacitor Clc is located between a pixel electrode PE of the thin film transistor array panel 10 and a common electrode CE of the common electrode panel 20. That is, the liquid crystal capacitor Clc has the pixel electrode PE of the thin film transistor array panel 100 and the common electrode CE of the common electrode display panel 20 as two terminals, and the liquid crystal layer 30 between the pixel electrode PE and the common electrode CE functions as a dielectric material.

The pixel electrode PE is connected to the switching transistor M1, and the common electrode CE is formed on the whole surface of the common electrode panel 20 and receives a common voltage Vcom. On the other hand, the common electrode CE may be provided on the thin film transistor array panel 10. In such case, at least one of two electrodes PE and CE may be made in the form of a line or a bar. The common voltage Vcom is a uniform voltage of a predetermined level, and may have the voltage near 0V.

The storage capacitor Cst has one terminal coupled with the pixel electrode PE and the other terminal coupled with the boost lines Bi. The boost lines Bi may be provided in the thin film transistor array panel 10, and the boost lines Bi and the pixel electrode PE may overlap via an insulator. The boost lines Bi may be applied with a predetermined voltage such as the common voltage Vcom.

A color filter CF may be formed on a portion of the region of the common electrode CE of the common electrode panel 20. Meanwhile, in order to realize color display, each pixel PX uniquely displays one of primary colors (spatial division), or each pixel PX temporally and alternately displays primary colors (temporal division). Then, the primary colors are spatially or temporally synthesized, and thus a desired color is recognized. An example of the primary colors may be three primary colors of red, green, and blue.

As an example of the spatial division, in FIG. 2, each pixel PX has a color filter CF that represents one of the primary colors in a region of the common electrode panel 20. Alternatively, the color filter CF may be formed above or below the subpixel electrode PEa or PEb of the lower thin film transistor array panel 10.

Each of the above-mentioned driving apparatuses 200, 300, 350, 400, and 500 may be directly mounted on the liquid crystal display panel assembly 600 in the form of at least one IC chip, or may be mounted on a flexible printed circuit film (not shown) and then mounted on the liquid crystal display panel assembly 600 in the form of a tape carrier package (TCP), or may be mounted on a separate printed circuit board (not shown). Alternatively, the drivers 200, 300, 350, 400, and 500 may be integrated with the liquid crystal display panel assembly 600 together with, for example, the signal lines G1-Gn, D1-Dm, and B1-Bn.

Now, an operation of the liquid crystal display LCD according to an exemplary embodiment of the present invention will be described.

Referring to FIG. 1 to 3, the signal controller 100 receives video signals R, G, and B input from an external device and input control signals for controlling display of the input video signals. The video signals R, G, and B include luminance information of each pixel PX, and the luminance has a predetermined number of grays, for example $1024=2^{10}$, $256=2^{8}$, or $64=2^{6}$. The input control signals exemplarily include a vertical synchronization signal (Vsync), a horizontal synchronization signal Hsync, a main clock signal MCLK, and a data enable signal DE.

The signal controller 100 processes the input video signals R, G, and B for operation conditions of the liquid crystal display panel assembly 600 and the data driver 300 based on the input video signals R, G, and B and the input control signals, and generates a scan control signal CONT1, a data control signal CONT2, and a boost control signal CONT3. The scan control signal CONT1 is provided to the scan driver 200. The data control signal CONT2 and a processed image data signal DAT are provided to the data driver 300. The boost control signal CONT3 is provided to the boost driver 400.

The scan control signal CONT1 includes a scan start signal STV that instructs the start of a scan and at least one clock signal controlling an output of a gate-on voltage Von. The scan control signal CONT1 may further include an output enable signal OE that limits the duration of the gate-on voltage Von.

The data control signal CONT2 includes a horizontal synchronization start signal STH that notifies the transmission start of the image data signal DAT of one pixel row, a load signal LOAD, and a data clock signal HCLK. The load signal LOAD and the data clock signal HCLK are provided for instruction of application of the data signal to the data lines D1-Dm. The data control signal CONT2 may further include a reversal signal POL that inverts the polarity of a voltage of the data signal with respect to the common voltage Vcom.

The boost control signal CONT3 controls the output of the boost signal BS that is applied from the boost driver 400 to the plurality of boost lines B1-Bn.

The scan driver 200 is connected to the plurality of scan lines S1 to Sn of the liquid crystal display panel assembly 600 to apply a scan signal to the plurality of scan lines S1 to Sn. The scan signal is formed of a combination of the gate-on voltage Von that turns on the switching switch M1 and a gate-off voltage Voff that turns off the switching switch M1 according to the scan control signal CONT1.

The data driver 300 receives the image data signal DAT, and the gray voltage generator 350 selects a gray voltage corresponding to the image data signal DAT. The data driver 300 applies the selected gray voltage to the plurality of data lines D1 to Dm as a data signal. The gray voltage generator 350 may provide a predetermined number of reference gray voltages rather than providing voltages for all the grays, and in this case, the data driver 300 may generate gray voltages for the entire grays by dividing the reference gray voltages and selecting a data voltage Vdat corresponding to the data signal.

The boost driver 400 transmits the boost signal BS to the plurality of boost lines B1-Bn of the liquid crystal panel assembly 600 according to the boost control signal CONT3.

The boost signal BS applied to the plurality of boost lines B1-Bn changes the level in synchronization with the scan signal Sout applied to the corresponding scan lines S1-Sn.

The boost voltage maintaining unit 500 restores the voltage generated in the boost lines B1-Bn by the coupling when the plurality of scan lines S1-Sn are applied with the scan signal Sout. The boost voltage maintaining unit 500 includes a transfer gate (TG) to switch a clock signal Sbf or a scan signal Sout controlling the output of the gate on voltage Von of the scan line S1-Sn as the, and applies the restoring voltage for restoring the voltage generated by the scan signal Sout by using the transfer gate switch to the boost lines B1-Bn.

If the scan driver 200 applies the gate on voltage Von to the scan line Si of one pixel row according to the scan control signal CONT1, the switching transistor M1 connected to the scan line Si is turned on, thereby the data signal applied to the plurality of data lines D1-Dm is applied to the corresponding pixel PX through the turned-on switching transistor M1. Here, the boost driver 400 transmits the boost signal BS to the plurality of boost lines B1-Bn of the liquid crystal panel assembly 600 according to the boost control signal CONT3.

A difference between the data voltage Vdat applied to the pixel PX and the common voltage Vcom is a charge voltage of the liquid crystal capacitor Clc, i.e., a pixel voltage. Here, the pixel voltage is boosted by the boost signal BS that has the level that is changed in synchronization with the scan signal Sout.

In FIG. 3, if the scan line Si is applied with the gate on voltage Von, the data voltage Vdat transmitted to the data line Dj is transmitted to the node A. Here, if the boost signal BS applied to the booster line Bi is changed, the voltage of the node A is boosted by the coupling. The generated electric field of the liquid crystal capacitor Clc corresponds to the difference between the voltage of the boosted node A and the common voltage Vcom, and the transmittance of light passing through the liquid crystal layer 30, thereby displaying images. As described above, the data signal is input to the pixel PX.

By repeating such a process using one horizontal period (may be called "1H", and is the same as a period of a horizontal synchronization signal Hsync and a data enable signal DE) in units, the gate-on voltage Von is sequentially applied to all the scan lines S1-Sn and the data signal is applied to all the pixels PX such that an image of a frame is displayed.

When one frame is finished and the next frame is started, the data driver 300 generates the data voltage according to the inversion signal POL for the polarity of the data voltage applied to each pixel PX to be the opposite to the polarity of the previous frame. This is referred to as frame inversion. At this time, the polarity of the image data signal flowing on one data line may be periodically changed even within one frame according to a characteristic of the inversion signal POL (for example, row inversion and dot inversion), or the polarity of the image data signal applied to one pixel row may also be changed (for example, column inversion and dot inversion).

The boost voltage maintaining unit 500 will now be described in detail. Referring to FIG. 4, the boost voltage maintaining unit 500 inputs the POL and the first boost signal in synchronization with the scan signal Sout, and outputs the second boost signal restoring the voltage generated in the boost lines B1-Bn by the coupling. The first boost signal is the boost signal BS(k−1) applied to the previous boost line among the boost signals sequentially applied to the plurality of boost lines B1-Bn corresponding to the scan signals that are sequentially applied. The second boost signal is the boost signal BS(k) having the boost voltage of the level before the change of the boost signal that is changed to boost the voltage of the pixel connected to the scan line applied with the scan signal Sout. The boost voltage of the level before the change to boost the voltage of the pixel is the restoring voltage. That is, the second boost signal has the restoring voltage for restoring the voltage generated in the boost lines B1-Bn by the coupling.

For this, a logic calculation circuit of the boost voltage maintaining unit 500 according to an exemplary embodiment of the present invention includes the first NOT operator inverting the inversion signal POL, a NAND operator connected thereto and having the inverted inversion signal and the first boost signal BS(k−1) as the input terminal, odd-numbered second NOT operators sequentially connected to the output terminal of the NAND operator, and a transfer gate switch having the scan clock signal Sbf(k) or the scan signal Sout(k) as the gate signal. The transfer gate switch is a CMOS transfer gate switch.

When it is assumed that the inversion signal POL is the low level and the first boost signal BS(k−1) is the high level, the inversion signal POL is inverted into the high level by the first NOT operator and is input to the NAND operator. The NAND operator outputs the signal of the low level according to the input of the inverted inversion signal POL of the high level and the first boost signal BS(k−1) of the high level. The output signal of the low level becomes the output signal of the high level through the second NOT operator. If the scan clock signal Sbf(k) or the scan signal Sout(k) is applied to the transfer gate switch, the second boost signal BS(k) of the high level is output.

When it is assumed that the inversion signal POL is the high level and the first boost signal BS(k−1) is the low level, the inversion signal POL is inverted into the low level of the first NOT operator and input to the NAND operator. The NAND operator outputs the signal of the high level according to the input of the inverted inversion signal POL of the low level and the first boost signal BS(k−1) of the low level. The output signal of the high level becomes the output signal of the low level through the second NOT operator. If the scan clock signal Sbf(k) or scan signal Sout(k) is input to the transfer gate switch, the second boost signal BS(k) of the low level is output.

When the inversion signal POL is the high level and the first boost signal BS(k−1) is the high level, or the inversion signal POL is the low level and the first boost signal BS(k−1) is the low level, the output signal of the NAND operator becomes the high level, and the output signal of the high level becomes the output signal of the low level through the second NOT operator. If the scan clock signal Sbf(k) or the scan signal Sout(k) is applied to the transfer gate switch, the second boost signal BS(k) of the low level is output.

Referring to FIG. 5, the boost voltage maintaining unit 500 receives the inversion signal POL and the first boost signal in synchronization with the scan signal Sout, and outputs the second boost signal restoring the voltage generated in the boost line B1-Bn by the coupling. The first boost signal is the boost signal BS(k−2) applied to the previous boost line among the boost signals that are sequentially applied to the plurality of boost lines B1-Bn corresponding to the scan signals that are sequentially applied. The second boost signal is the boost signal BS(k) having the boost voltage of the level before the change of the boost signal that is changed for boosting the voltage of the pixel connected to the scan line that is applied with the scan signal Sout.

For this, a logic calculation circuit of the boost voltage maintaining unit 500 according to another exemplary embodiment of the present invention includes the NAND operator receiving the inversion signal POL and the first boost signal BS(k−2) as the input terminal, the even-numbered NOT operator sequentially connected to the output terminal of the NAND operator, and a transfer gate switch receiving the scan clock signal Sbf(k) or the scan signal Sout(k) as the gate signal. The transfer gate switch is the CMOS transfer gate switch.

It is assumed that the inversion signal POL is the high level and the first boost signal BS(k−2) is the high level. The NAND operator outputs the signal of the low level according to the input of the inversion signal POL of the high level and the first boost signal BS(k−2) of the high level. The output signal of the low level becomes the output signal of the low level through the even-numbered NOT operator. If the scan clock signal Sbf(k) or the scan signal Sout(k) is applied to the transfer gate switch, the second boost signal BS(k) of the low level is output.

It is assumed that the inversion signal POL is the low level and the first boost signal BS(k−2) is the low level. The NAND operator outputs the signal of the high level according to the input of the inversion signal POL of the low level and the first boost signal BS(k−2) of the low level. The output signal of the high level becomes the output signal of the high level through the even-numbered NOT operators. If the scan clock signal Sbf(k) or the scan signal Sout(k) is applied to the transfer gate switch, the second boost signal BS(k) of the high level is output.

When the inversion signal POL is the high level, and the first boost signal BS k−2 is the low level, or the inversion signal POL is the low level and the first boost signal BS k−2 is the high level, the output signal of the NAND operator becomes the high level, and the output signal of the high level becomes the output signal of the high level through the NOT operators of the even numbered. If the scan clock signal Sbf(k) or the scan signal Sout(k) is applied to the transfer gate switch, the second boost signal BS(k) of the high level is output.

Next, the configuration and operation of the liquid crystal display (LCD) according to another exemplary embodiment of the present invention will be described with reference to FIG. 6 to 8. The different points from the liquid crystal display of FIG. 1 will be mainly described.

Figure 6:
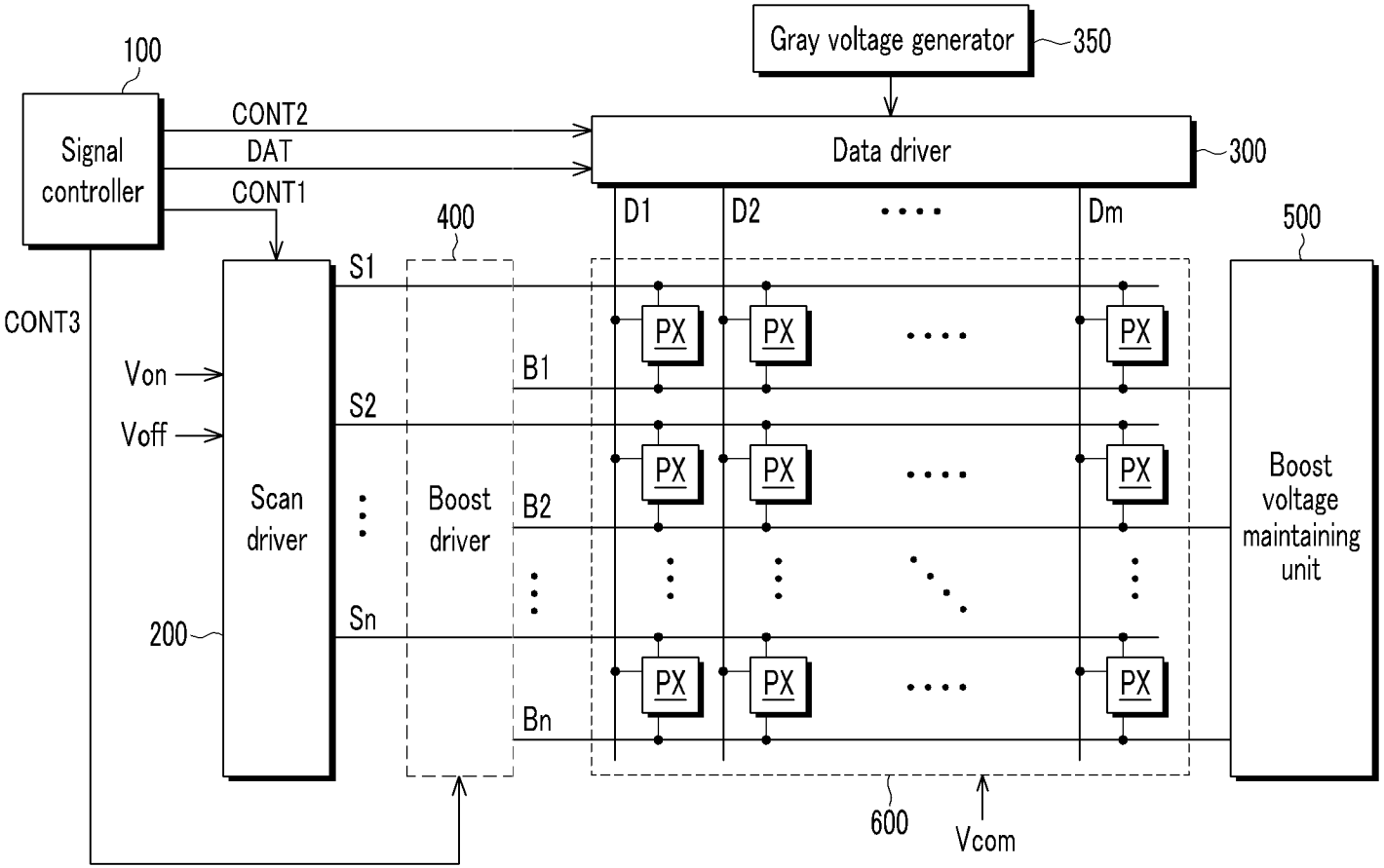
FIG. 6 is a block diagram of a liquid crystal display (LCD) according to another exemplary embodiment of the present invention.

FIG. 6 is a block diagram of a liquid crystal display (LCD) according to another exemplary embodiment of the present invention. FIG. 7 is an example of a logic calculation circuit of the boost voltage maintaining unit of FIG. 6. FIG. 8 is another example of a logic calculation circuit of the boost voltage maintaining unit of FIG. 6.

The structure of the liquid crystal display (LCD) illustrated in FIG. 6, differs from the structure of the LCD illustrated in FIG. 1 in that the scan driver 200 and the boost driver 400 are disposed on the same side of the liquid crystal panel assembly 600. When the scan driver 200 and the boost driver 400 are disposed on the same side of the liquid crystal panel assembly 600, the boost voltage maintaining unit 500 is disposed on the other side of the liquid crystal panel assembly 600.

When the boost voltage maintaining unit 500 and the scan driver 200 are disposed on opposite sides of the liquid crystal panel assembly 600, the boost voltage maintaining unit 500 may use the scan signal Sout as the gate signal of the transfer gate switch without the scan clock signal Sbf.

Figure 7:
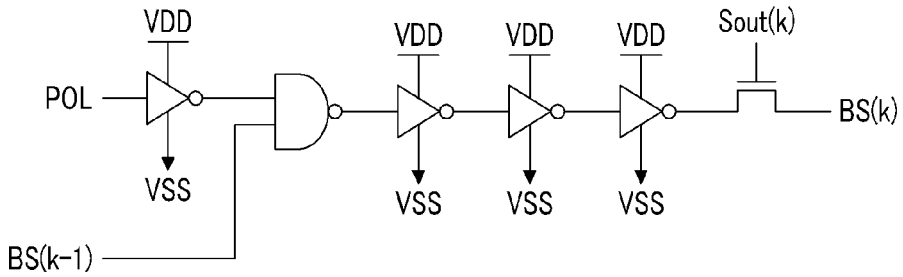
FIG. 7 is one example of a logic calculation circuit of the boost voltage maintaining unit of FIG. 6.

Referring to FIG. 7, the boost voltage maintaining unit 500 receives the inversion signal POL and the first boost signal in synchronization with the scan signal Sout, and outputs the second boost signal restoring voltage generated in the boost lines B1-B by the coupling. The first boost signal is the boost signal BS(k−1) applied to the previous boost line among the boost signals sequentially applied to the plurality of boost lines B1-Bn corresponding to the scan signals that are sequentially applied. The second boost signal is the boost signal BS(k) having the boost voltage of the level before the change of the boost signal that is changed to boost the voltage of the pixel connected to the scan line applied with the scan signal Sout.

For this, a logic calculation circuit of the boost voltage maintaining unit 500 according to another exemplary embodiment includes the first NOT operator inverting the inversion signal POL, a NAND operator connected thereto and receiving the inverted inversion signal and first boost signal BS(k−1) as the input terminal, the odd-numbered second NOT operators sequentially connected to the output terminal of the NAND operator, and the transfer gate switch having the scan signal Sout(k) as the gate signal. The transfer gate switch is the NMOS transfer gate switch.

That is, the NMOS transfer gate switch having the scan signal Sout(k) as the gate signal is used instead of the CMOS transfer gate switch in the logic calculation circuit of the boost voltage maintaining unit 500 according to the embodiment illustrated in FIG. 4. The logic calculation circuit of the boost voltage maintaining unit 500 illustrated in FIG. 7 is operated like the logic calculation circuit of the boost voltage maintaining unit 500 illustrated in FIG. 4.

Figure 8:
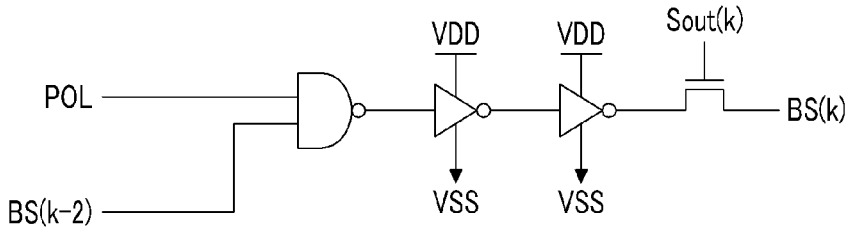
FIG. 8 is another example of a logic calculation circuit of the boost voltage maintaining unit of FIG. 6.

Referring to FIG. 8, the boost voltage maintaining unit 500 inputs the inversion signal POL and the first boost signal in synchronization with the scan signal Sout, and outputs the second boost signal restoring the voltage generated in the boost lines B1-Bn by the coupling. The first boost signal is the boost signal BS(k−2) applied to the secondly previous boost line among the boost signals sequentially applied to the plurality of boost lines B1-Bn corresponding to the scan signals that are sequentially applied. The second boost signal is the boost signal BS(k) having the boost voltage of the level before the change of the boost signal that is changed to boost the voltage of the pixel connected to the scan line applied with the scan signal Sout.

For this, the logic calculation circuit of the boost voltage maintaining unit 500 according to another exemplary embodiment of the present invention includes a NAND operator receiving the inversion signal POL and the first boost signal BS(k−2) as the input terminal, the even-numbered NOT operators sequentially connected to the output terminal of the NAND operator, and a transfer gate switch receiving the scan signal Sout(k) as the gate signal. The transfer gate switch is an NMOS transfer gate switch.

That is, the NMOS transfer gate switch receiving the scan signal Sout(k) as the gate signal is used instead of the CMOS transfer gate switch in the logic calculation circuit of the boost voltage maintaining unit 500 illustrated in FIG. 5. The logic calculation circuit of the boost voltage maintaining unit 500 illustrated in FIG. 8 is operated like the logic calculation circuit of the boost voltage maintaining unit 500 illustrated in FIG. 5.

Next, an operation restoring the noise (the voltage generated by the coupling) in the boost lines B1-B in the boost voltage maintaining unit 500 when the scan signal Sout is applied to the liquid crystal display (LCD) and the data signal is applied to the pixel PX will be described with reference to FIG. 9.

Figure 9:
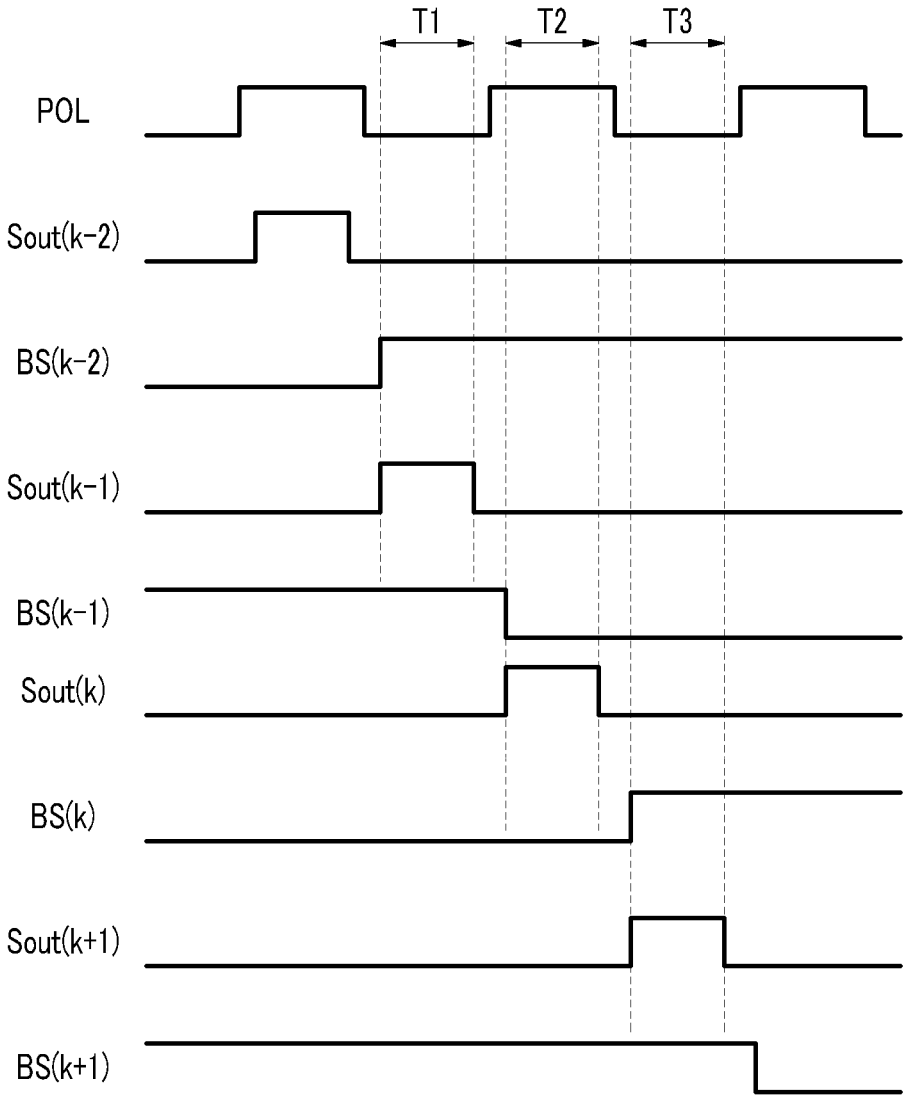
FIG. 9 is a timing diagram explaining an operation of a liquid crystal display (LCD) according to an exemplary embodiment of the present invention.

FIG. 9 is a timing diagram explaining an operation of a liquid crystal display (LCD) according to an exemplary embodiment of the present invention.

Referring to FIG. 9, it is assumed that the liquid crystal display (LCD) according to an aspect of the present invention is operated according to a line inversion (a row inversion) driving method. According to the line inversion method, a plurality of boost signals have the inversion waveform having the predetermined phase difference between the neighboring boost signals, and each of the boost signals alternately has the high level or the low level as one frame unit. The data signals are applied to the plurality of pixels, and the polarities thereof are inverted as the unit of one horizontal period.

In the line inversion driving method, the inversion signal POL alternately has the high level and the low level as the unit of one horizontal period. For example, the data signal of the high level that is higher than the common voltage Vcom may be applied to the plurality of data lines D1-Dm according to the inversion signal POL of the high level, and the data signal of the low level that is lower than the common voltage Vcom may be applied to the plurality of data lines D1-Dm according to the inversion signal POL of the low level.

The plurality of scan lines S1-Sn are sequentially applied with the scan signal Sout as the unit of one horizontal period, and the boost signal BS to restore the noise generated in the boost lines B1-Bn respectively corresponding to the scan lines S1-Sn is applied to the corresponding boost lines B1-Bn. The voltage of the boost signal BS to restore the noise is referred to as the restoring voltage, and the restoring voltage refers to the boost voltage before the change for boosting the pixel voltage.

It is assumed that a section where the (k−1)-th scan line is applied with the scan signal Sout(k−1) is referred to as T1, a section where the k-th scan line is applied with the scan signal Sout(k) is referred to as T2, and a section where the (k+1)-th scan line is applied with the scan signal Sout(k+1) is referred to as T3 (0<k<n, integer).

At the starting point of the section T1, the (k−1)-th scan line is applied with scan signal Sout(k−1) as the high level, and the (k−1)-th boost line is applied with the boost voltage of the high level. If the scan signal Sout(k−1) is applied, the voltage by the coupling is added to the boost voltage of the high level. Here, the (k−1)-th boost line is applied with the same restoring voltage as the boost voltage of the high level such that the voltage by the coupling is removed and the boost voltage of the high level is maintained.

The boost voltage maintaining unit 500 may use one of the logic calculation circuits illustrated in FIGS. 4, 5, 7 and 8.

Under the usage of the logic calculation circuit according to the circuit illustrated in FIG. 4 or the circuit illustrated in FIG. 7, the inversion signal POL is the low level and the first boost signal BS(k−2) of the (k−2)-th boost line is the high level at the section T1 such that the second boost signal BS(k−1) of the high level is output and applied to the (k−1)-th boost line. That is, the (k−1)-th boost line is applied with the restoring voltage of the same voltage as the boost voltage of the high level.

If the section T1 is finished, the scan signal Sout(k−)1 of the high level is not applied such that the application of the restoring voltage to the (k−1)-th boost line is stopped. Next, the boost voltage is changed into the low level for boosting the voltage of the pixel connected to the (k−1)-th boost line. The change time of the boost voltage of the (k−1)-th boost line may be synchronized to a time when the scan signal Sout(k) is applied to the k-th scan line.

At the starting point of the section T2, the scan signal Sout(k) is applied to the k-th scan line as the high level, and the k-th boost line is applied with the boost voltage of the low level. If the scan signal Sout(k) is applied, the voltage by the coupling is added to the boost voltage of the low level, and the k-th boost line is applied with the same restoring voltage as the boost voltage of the low level such that the voltage by the coupling is removed and the boost voltage of the low level is maintained.

When using the logic calculation circuit illustrated in FIG. 4 or the circuit illustrated in FIG. 7, the inversion signal POL is the high level and the first boost signal BS(k−1) of the (k−1)-th boost line is the low level at the section T2 such that the second boost signal BS(k) of the low level is output and applied to the k-th boost line.

When using the logic calculation circuit illustrated in FIG. 5 or illustrated in FIG. 8, the inversion signal POL is the high level and the first boost signal BS(k−2) of the (k−2)-th boost line is the high level at the section T2 such that the second boost signal BS(k) of the low level is output and applied to the k-th boost line.

That is, the restoring voltage of the same voltage as the boost voltage of the low level is applied to the k-th boost line.

If the section T2 is ended, the scan signal Sout(k) of the high level is not applied such that the application of the restoring voltage to the k-th boost line is stopped. Next, the boost voltage is changed into the high level for boosting the voltage of the pixel connected to the k-th boost line. The change time of the boost voltage of the k-th boost line may be synchronized to the time that the scan signal Sout(k+1) is applied to the (k+1)-th scan line.

At the starting point of the section T3, the scan signal Sout(k+1) is applied to the (k+1)-th scan line as the high level, and the (k+1)-th boost line is applied with the boost voltage of the high level. If the scan signal Sout(k+1) is applied, the voltage by the coupling is added to the boost voltage of the high level, and the same restoring voltage as the boost voltage of the high level is applied to the (k+1)-th boost line such that the voltage by the coupling is removed and the boost voltage of the high level is maintained.

When using the logic calculation circuit illustrated in FIG. 4 or the circuit illustrated in FIG. 7, the inversion signal POL is the low level and the first boost signal BS(k) of the k-th boost line is the high level at the section T3 such that the second boost signal BS(k+1) of the high level is output and applied to the (k+1)-th boost line.

When using the logic calculation circuit illustrated in FIG. 5 or illustrated in FIG. 8, the inversion signal POL is the low level and the first boost signal BS(k−1) of the (k−1)-th boost line is the low level at the section T3 such that the second boost signal BS(k+1) of the high level is output and applied to the (k+1)-th boost line.

That is, the same restoring voltage as the boost voltage of the high level is applied to the (k+1)-th boost line.

If the section T3 is finished, the scan signal Sout(k+1) of the high level is not applied such that the application of the restoring voltage to the (k+1)-th boost line is stopped. Next, the boost voltage is changed into the low level for boosting the voltage of the pixel connected to the (k+1)-th boost line.

As described above, the voltage generated in the boost line by the coupling along with the scan signal may be restored by applying the restoring voltage.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A display device comprising:

a plurality of pixels;

a data driver connected to the plurality of pixels by a plurality of data lines and applying data signals to the plurality of pixels;

a scan driver connected to the plurality of pixels by a plurality of scan lines and applying scan signals to the plurality of pixels for the data signals to be applied to the plurality of pixels;

a boost driver connected to the plurality of pixels by a plurality of boost lines and applying boost signals, boosting a pixel voltage charged to the plurality of pixels by the data signals, to the plurality of pixels; and a boost voltage maintaining unit receiving i) an inversion signal inverting a polarity of the data signals and ii) the boost signals, and applying a restoring voltage, restoring a voltage in the plurality of boost lines by the scan signal, to the plurality of boost lines, the boost voltage maintaining unit comprising a transfer gate switch having at least one of a clock signal and the scan signal as the gate signal turning on the transfer gate switch, wherein the restoring voltage is selected to reduce noise on the boost signals generated due to coupling between the boost lines and at least one of the data lines or scan lines.

2. The display device of claim 1, wherein:

the boost driver is connected to one end of the plurality of boost lines, and the boost voltage maintaining unit is connected to another end of the plurality of boost lines.

3. The display device of claim 1, wherein:

the boost voltage maintaining unit applies the restoring voltage by using a clock signal controlling the output of the scan signals or the scan signals as a gate signal.

4. The display device of claim 3, wherein the boost voltage maintaining unit includes:

a NAND operator receiving the inversion signal and a previously applied boost signal as an input signal;

at least one NOT operator sequentially connected to an output terminal of the NAND operator; and a transfer gate switch connected to the at least one NOT operator and receiving the clock signal or the scan signals as the gate signal.

5. The display device of claim 4, wherein:

the boost voltage maintaining unit further includes a NOT operator inverting the inversion signal.

6. The display device of claim 4, wherein:

the previously applied boost signal is a boost signal that is applied to a previous boost line among the boost signals that are sequentially applied to the plurality of boost lines.

7. The display device of claim 6, wherein:

the at least one NOT operator is odd-numbered.

8. The display device of claim 4, wherein:

the previously applied boost signal is a boost signal that is applied to a previous boost line among the boost signals that are sequentially applied to the plurality of boost lines.

9. The display device of claim 8, wherein:

the at least one NOT operator is even-numbered.

10. The display device of claim 4, wherein:

the transfer gate switch is a CMOS transfer gate switch having the clock signal and the scan signal as the gate signal.

11. The display device of claim 10, wherein:

the scan driver and the boost driver are disposed on a same side of a panel including the plurality of pixels.

12. The display device of claim 4, wherein:

the transfer gate switch is an NMOS transfer gate switch having the scan signal as the gate signal.

13. The display device of claim 12, wherein:

the scan driver and the boost driver are disposed at opposite sides of a panel including the plurality of pixels.

14. The display device of claim 1, wherein:

the restoring voltage is the boost voltage of a level before a change to boost the voltage of the plurality of pixels.

15. The display device of claim 1, wherein:

the data driver inverts the polarity of the data signals as a unit of one horizontal period and applies the data signals to the plurality of pixels.

16. A display device comprising:

a plurality of pixels;

a data driver connected to the plurality of pixels by a plurality of data lines and applying data signals to the plurality of pixels;

a scan driver connected to the plurality of pixels by a plurality of scan lines and applying scan signals to the plurality of pixels for the data signals to be applied to the plurality of pixels;

a boost driver connected to the plurality of pixels by a plurality of boost lines and applying boost signals, boosting a pixel voltage charged to the plurality of pixels by the data signals, to the plurality of pixels; and a boost voltage maintaining unit receiving i) an inversion signal inverting a polarity of the data signals and ii) the boost signals, and applying a restoring voltage, restoring a voltage in the plurality of boost lines by the scan signal, to the plurality of boost lines, the boost voltage maintaining unit comprising a transfer gate switch having at least one of a clock signal and the scan signal as the gate signal turning on the transfer gate switch, wherein the boost voltage maintaining unit applies the restoring voltage via the transfer gate switch and wherein the boost voltage maintaining unit comprises a logic operator receiving the inversion signal and a previously applied boost signal as input signals.

17. The display device of claim 16, wherein:

the boost driver is connected to one end of the plurality of boost lines, and the boost voltage maintaining unit is connected to another end of the plurality of boost lines.

18. The display device of claim 16, wherein the boost voltage maintaining unit includes:

a NAND operator receiving the inversion signal and a previously applied boost signal as an input signal;

at least one NOT operator sequentially connected to an output terminal of the NAND operator; and a transfer gate switch connected to the at least one NOT operator and receiving the clock signal or the scan signal as the gate signal.

19. The display device of claim 18, wherein:

the previously applied boost signal is a boost signal that is applied to a previous boost line among the boost signals that are sequentially applied to the plurality of boost lines.

20. The display device of claim 16, wherein:

the scan driver and the boost driver are disposed on a same side of a panel including the plurality of pixels.

21. The display device of claim 16, wherein:

the data driver inverts the polarity of the data signals as a unit of one horizontal period and applies the data signals to the plurality of pixels.

* * * * *